United States Patent [19]

Krene et al.

[11] 4,181,307

[45] Jan. 1, 1980

[54] GOLF TRAINING DEVICE

[76] Inventors: Joseph I. Krene, 6206 Roeding Rd., Hughson, Calif. 95326; William T. Campbell, Simmonscourt Castle, Ballsbridge, Dublin 4, Ireland

[21] Appl. No.: 911,109

[22] Filed: May 31, 1978

[51] Int. Cl.[2] ..... A63B 69/36

[52] U.S. Cl. ..... 273/183 A; 273/186 C; 273/35 A; 273/187 A

[58] Field of Search ..... 273/176 H, 35 A, 183 A, 273/187 R, 187 A, 187 B, 195 R, 195 B, 186 C; 35/29 A

[56] References Cited

U.S. PATENT DOCUMENTS

| | | | |
|---|---|---|---|
| 3,097,437 | 7/1963 | Harrison | 35/29 A |
| 3,110,495 | 11/1963 | Carter | 273/35 A |
| 3,917,278 | 11/1975 | Steinman | 273/183 E |
| 3,934,874 | 1/1976 | Henderson | 273/35 A |
| 3,934,882 | 1/1976 | Whittaker | 273/183 A |
| 3,936,055 | 2/1976 | Scott | 273/176 H |

FOREIGN PATENT DOCUMENTS

| | | | |
|---|---|---|---|
| 1063586 | 3/1967 | United Kingdom | 273/187 R |
| 1258018 | 12/1971 | United Kingdom | 273/35 A |

*Primary Examiner*—George J. Marlo
*Attorney, Agent, or Firm*—Young & Thompson

[57] ABSTRACT

A golf training device comprises a platform on which a golfer stands, a platform on which a golf ball is supported and a mirror arranged between the two platforms so that the golfer can see his swing as he hits the ball. The device shown in the drawings comprises three units which are hinged together along the adjacent longitudinal edges, the central unit being a mirror unit comprising an elongated mirror swivelably mounted in a frame.

7 Claims, 3 Drawing Figures

GOLF TRAINING DEVICE

BACKGROUND OF THE INVENTION

The present invention relates to a golf training device, more particularly for use by a golfer who wishes to improve his "swing", i.e. the manner in which he swings a golf club when hitting a golf ball.

It is extremely difficult for a golfer to correct or improve his own "swing" because he needs another person, preferably a professional instructor, to watch him while he is hitting the ball. Some use has been made of film or video-tape to record a golfer's swing so that it can be analysed afterwards but this is an ex post facto method and the golfer must wait to see the results.

Many different forms of golf training aid have been proposed previously. British Pat. No. 1,258,018 of Devac Inc. describes a golf club pratice swing guide comprising a mechanical assembly of pivoted arms mounted on an upright post, one end of one arm being adapted to be clamped to the shaft of a golf club. For the purpose of assisting the golfer to note and correct errors in stance and swing, a square mirror is adjustably mounted on the upright so that the golfer can view his actions and see how he is swinging the club as well as feeling from the mechanical assembly whether he is swinging improperly. However when the guide is in use the upright carrying the mirror is located opposite the golfer on the far side of a mat on which the golf ball to be hit is placed. Therefore in order to look in the mirror, the golfer must raise his eyes from the ball to the mirror beyond it. Thus, apart from the artificiality of swinging a club attached to an elaborate mechanism, the swing guide of British Pat. No. 1,258,018 would also tend to distract the golfer from keeping his head down and his eyes on the ball.

British Pat. No. 1,063,586 of W. McG. Lees describes a golf practice device having a striking surface on which a golf ball is placed and two parallel elongated guide means above the plane of the striking surface spaced slightly greater than the heel to toe distance of a wooden club. When the club head strikes either of the guides during a practice swing, the player "feels" the contact and may endeavour to avoid such contact in future. The device may also include a support on which the player takes his stance, this support being spaced away from the striking surface and having lines marked thereon to indicate the correct position of the player's feet. In use, this device would tend to inhibit a golfer's fluency of swing because of the need to fit the club head between the guide means.

It is an object of the present invention to provide a simple form of golf training device which enables a golfer to observe and correct his set-up to the ball and his swing without any constraints on the movement of his golf club and without any necessity to raise his eyes away from the golf ball to be hit.

SUMMARY OF THE INVENTION

The present invention provides a golf training device comprising a foot placement member, a ball placement member, and a mirror arranged between the said two members so that a golfer standing on the foot placement member can see himself as he hits a ball on the ball placement member.

Preferably the mirror is adjustably mounted between the foot placement member and the ball placement member.

In a preferred embodiment of the invention, the mirror is elongated in the direction of the golfer's swing, i.e. elongated in the same direction as the foot placement member is elongated in order to accommodate both feet of a golfer, and it is particularly preferred to have lines marked on the mirror parallel to the direction of swing.

DESCRIPTION OF THE DRAWINGS

One embodiment of the invention is illustrated in the accompanying drawings, in which.

Figure 1:
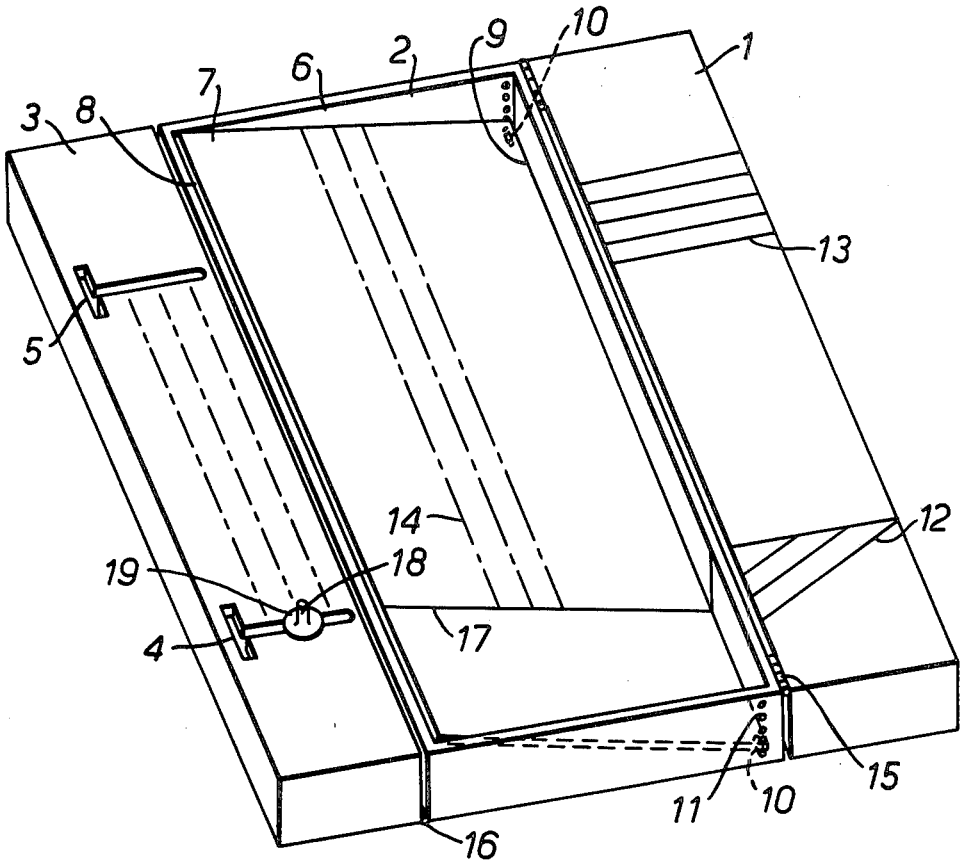
FIG. 1 is a perspective view of a golf training aid in accordance with the invention, showing the device in the unfolded position.
Figure 2:
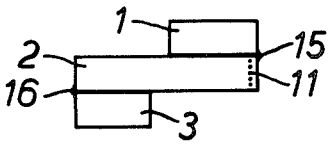
FIG. 2 is an end view of a golf training aid similar to that of FIG. 1 but showing the device in the folded position.

As shown in the drawings, the golf training aid comprises a foot support 1, a mirror unit 2 and a ball support 3, hinged together along their adjacent longitudinal edges with the mirror unit 2 arranged between the foot support 1 and the ball support 3. The foot support 1 is a platform which is wide enough to accommodate the length of a golfer's feet and long enough at least to accommodate the spread of a golfer's feet when the golfer is swinging a club. The mirror unit 2 is of such a width that the ball support is spaced away from the foot support by approximately the distance that a golfer places the ball in front of his feet. Obviously these dimensions can be varied depending upon the size of golfers who are likely to use the training aid. However, the dimensions can be made big enough to accommodate the reach and stance of all golfers. Preferably, as shown in the drawings, the foot support 1 is considerably longer than is necessary to accommodate the spread of the average golfer's feet.

Figure 3:
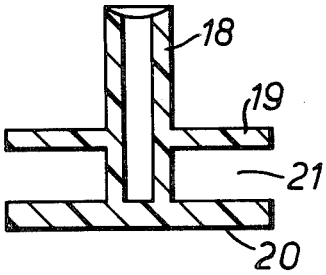
FIG. 3 is a cross-sectioned projection of a tee device for use with the golf training aid of the invention.

The ball support 3 has two T-shaped slots 4, 5 extending across it, one near to each end. The tee slots are suitable to receive a tee device as shown in FIG. 3. Variation in placement of the tee is achieved by moving the tee device in the slot which will provide an infinite number of settings to accommodate different club lengths and golfers of varying heights. The slot 4 is for use by right handed golfers while the slot 5 is for use by left handed golfers.

The mirror unit 2 comprises a rectangular frame 6 having a mirror 7 adjustably mounted therein. The mirror 7 is elongated in the direction parallel to the edge of the foot support 1. The edge 8 of the mirror 7 nearer to the ball support 3 rests on a lip near to the top of the frame. The edge 9 of the mirror nearer to the foot support rests on a pair of pegs 10 which may be located in any of two sets of holes 11 at opposite ends of the frame.

The foot support 1 is marked with two sets of lines 12, 13 in positions corresponding to the two foot positions. These lines may be used to check and vary the disposition of the feet. The lines shown in the drawings are for use by right handed golfers but an alternative set for left handed golfers may also be marked for example in a different colour.

The mirror 7 is marked with parallel lines 14 in a longitudinal direction. The mirror is also marked with a transverse line 17 extending from the inside edge of the left foot marking 12 on the foot support to the tee slot 4.

The longitudinal lines 14 extend from transverse line 17 in the backswing direction. The ball support 3 is marked with longitudinal lines parallel with the longitudinal lines on the mirror.

As shown in FIG. 3, a tee device comprises a stem 18 having two annular flanges 19 and 20 separated by a channel 21 which is marginally less wide than the depth of the sheet of material forming the top of the ball support platform. The top of the stem 18 is concave in the same manner as a standard golf tee. The tee device is moulded of a flexible plastics or elastomeric material so that it will bend if hit by a golf club. It can be inserted into the head of the T-shaped slot 4, 5 and will then slide along the slot with flange 19 above the ball support surface and flange 20 beneath it. The stem 18 between the flanges has a diameter marginally greater than the width of the slot 4, 5 so that the tee device is a tight fit in the slot.

The foot support, ball support and mirror unit-frame may suitably be made of wood, metal or plastics material or of any rigid material which is reasonably light and strong. The mirror may be of glass or is suitably made of a rigid plastics material such as an acrylic plastics material which has been silvered or otherwise treated to form a mirror.

The overall size of the golf training aid may suitably be about 4 feet long, about 4 feet wide in the unfolded position and about 4 inches in depth. The mirror unit may suitably be about 18–20 inches wide and 4 feet long.

Hinges 15, 16 are provided on both longitudinal edges of the mirror unit so that the ball support can be folded on top of the mirror unit. When folded the unit will be about 20 inches wide, 4 feet long and 12 inches deep.

The foldable device as shown in the drawings is convenient to carry. However, a non-foldable device is envisaged for use in golf clubs, driving ranges and the like where the device could be kept in one position for use by many golfers.

When a golfer stands with his feet on the foot support and drives a ball set on a tee device in one of the tee slots on the ball support, provided that the mirror is inclined correctly so that he can see himself while he looks at the ball on the tee, the device permits immediate direct observation by the golfer of the following:

(1) The position of the hands, head, shoulders, hips, legs, etc. in relation to the ball.
(2) Recommended positions of the feet.
(3) Underside of the hands.
(4) Movement of the hands during backswing in relation to the longitudinal lines marked on the mirror.
(5) Sway, i.e. movement of head and body on backswing.
(6) Whether the club is being taken back inside or outside the plane of swing.
(7) Any rotational movement of the hands during backswing.
(8) Any faults which may have developed unconsciously in the swing.

Variations may be made in the embodiment as described above without departing from the spirit of the invention. For example the second tee slot 5 may be omitted. In another embodiment of the invention, there are no tee slots and tees are not used but the ball support has a soft resilient surface, for example of foamed plastics material, over part or all of its area so that a ball can be hit directly off the surface. The foot support and the ball support, instead of being platforms, may be mats and means may be provided to prop the mirror in an inclined position relative to the plane of the mats.

Means other than pegs 10 may be used for varying the angle of inclination of the mirror.

We claim:

1. A golf training device comprising a foot support member presenting a platform to accommodate the feet of a golfer, a ball placement member having means to locate a golf ball in position to be hit by a golfer standing on the foot support member, a frame connecting the foot support member and the ball placement member so as to define a space therebetween, and a mirror mounted in the said space less distant from the foot support member than is the ball placement member, the mirror being arranged so that a golfer standing on the foot support member can directly observe his image between his feet and the ball as he swings a club to hit the ball located on the ball placement member.

2. A device according to claim 1, wherein the mirror is adjustably mounted between the foot placement member and the ball placement member so that the angle of inclination of the mirror relative to the plane of the foot placement member can be varied.

3. A device according to claim 1, wherein the mirror is elongated in the direction of the golfer's swing.

4. A device according to claim 3, wherein the mirror is marked with lines parallel to the direction of swing.

5. A device according to claim 1 comprising a foot support platform, a ball support platform and a mirror unit hinged together along adjacent longitudinal edges with the mirror unit arranged between the foot support platform and the ball support platform.

6. A device according to claim 5, wherein the ball support platform is provided with at least one slot to receive a tee device.

7. A device according to claim 5, wherein the mirror unit comprises a frame and a mirror mounted therein for swiveling movement relative to the frame.

* * * * *